US008529364B1

(12) United States Patent
De Anda

(10) Patent No.: US 8,529,364 B1
(45) Date of Patent: Sep. 10, 2013

(54) GOLF TRAINING AID

(76) Inventor: Keir De Anda, Las Vegas, NV (US)

( * ) Notice: Subject to any disclaimer, the term of this patent is extended or adjusted under 35 U.S.C. 154(b) by 0 days.

(21) Appl. No.: 13/585,684

(22) Filed: Aug. 14, 2012

(51) Int. Cl.
*A63B 69/36* (2006.01)

(52) U.S. Cl.
USPC ..... 473/220; 473/257; 473/261

(58) Field of Classification Search
USPC ..... 473/150, 173, 220, 257, 260, 261, 473/262, 264, 265, 278, 409
See application file for complete search history.

(56) References Cited

U.S. PATENT DOCUMENTS

| | | | | |
|---|---|---|---|---|
| 3,312,474 | A * | 4/1967 | Mitchell | 473/264 |
| 3,860,247 | A * | 1/1975 | Taylor | 473/218 |
| 3,899,180 | A * | 8/1975 | Rodman | 473/265 |
| 3,934,874 | A | 1/1976 | Henderson | |
| 5,116,058 | A * | 5/1992 | Theriault | 473/268 |
| 5,409,231 | A * | 4/1995 | Kueng et al. | 473/261 |
| 5,431,403 | A * | 7/1995 | Pelz | 473/160 |
| 5,443,265 | A | 8/1995 | Wheeler | |
| 6,036,608 | A | 3/2000 | Morris | |
| 6,179,722 | B1 | 1/2001 | Bond | |
| 6,443,852 | B1 | 9/2002 | Kim | |
| 6,503,152 | B1 * | 1/2003 | Pelz | 473/257 |
| 6,840,870 | B1 | 1/2005 | Froggatte | |
| 6,869,288 | B1 | 3/2005 | Faulkner | |
| 7,134,966 | B1 | 11/2006 | Tice | |
| 7,255,649 | B1 | 8/2007 | McConnell | |
| 7,850,536 | B1 | 12/2010 | Fitzgerald | |
| 2003/0236127 | A1 | 12/2003 | Richter | |
| 2008/0287206 | A1 | 11/2008 | Kinney | |
| 2009/0181787 | A1 | 7/2009 | Lane | |

* cited by examiner

*Primary Examiner* — Nini Legesse
(74) *Attorney, Agent, or Firm* — Lawrence Lambelet

(57) ABSTRACT

The present invention is an apparatus and method enabling a controlled approach to making accurate puts in golfing. The apparatus uses laser aiming, measured stroking distances, and a surface analysis aid to benchmark a perfect put. The method enhances control by eliminating the back half of the swing while providing data points for reassessment of performance during practice training.

17 Claims, 5 Drawing Sheets

GOLF TRAINING AID

FIELD OF THE INVENTION

This invention relates to golf training aids, and particularly to an apparatus and method facilitating putting performance.

BACKGROUND OF THE INVENTION

Among the critical skills required for competitive golfing, putting, arguably, is one of the most important. On an 18-hole course, not less than half of the par strokes are dedicated to putting. The successful putting stroke requires accurate aim and a measured amount of is momentum in the ball strike. The slope of the playing surface, which in some cases is too subtle for casual notice, may cause the ball to "break" from a straight line approach.

Training aids to assist the recreational golfer in mastering putting are known in the art. Most of these provide alignment guides and some attempt to limit the backstroke of the swing by providing a stop interface. An initial alignment can be lost, however, by contact with rails, or stops, which are intended to guide or limit the head of the putter club during the club swing. As a matter of fact, some alignment can be lost in the act of making a backstroke, which, together with the forward stroke and follow-through, comprises the golf swing.

What is missing in the field of art is a training aid which is free of interferences for the swing while, at the same time, providing accurate aiming and precision application of ball-striking force. Such a guide should be compact for portability and accessibility while simple to operate and modest in cost.

SUMMARY OF THE INVENTION

The "aiming" component of the putting stroke can be divided into two parts. The first part is determining a direction which will result in the ball rolling into the cup. The preferred direction is not always a sight-line to the cup. Typically, the character of the playing surface, including irregularities in slope, flatness or texture, must be taken in consideration. The second part is hitting the ball squarely, so that the ball follows the intended trajectory along the preferred direction.

In the training aid of the present invention, a novel combination of features is used to assist with the direction-finding first part. A reflective target is placed at an initial aiming point and a laser is used to find orientation to the target. A bubble level is used to indicate inclination of the field. Lastly, perpendicular aiming lines are used to indicate both the preferred direction and the golfer's facing direction with respect to a proper stance. The aiming lines facilitate the golfer's visualization of the act, the visualization, in and of itself, enhancing the performance.

Regarding the second part of the aim, the present invention embodies both a novel method and a means to facilitate said method in the training aid. The backstroke is essentially a "wind-up" to the swing. In putting situations, the wind-up may not be necessary to gather sufficient force for the ball strike. After all, the ball makes a controlled roll over the putting green, not an airborne flight. Eliminating the backstroke eliminates a tendency to twist the club caused by the preferred two-handed grip. The twist is a consequence of the muscles in the two arms being differentially flexed during the swing. Realigning the backstroke with a stopping surface is not the answer because the fluidity of the swing is placed in jeopardy by the resulting collision.

A better method is to limit the swing to a forward stoke beginning with an alignment of is the club head to the preferred direction. This alignment is achieved in the present apparatus with the head abutting an aimed vertical feature. The forward stoke is purposely uninhibited, in the present case, by avoiding guiding rails, or other constraints intended to steer the stroke. While conceptually beneficial, such constraints pose the risk of making accidental contact with the swinging club and skewing the alignment in unintentional consequence.

The "momentum" component of the putting stroke comes down to judging the amount of force in the swing for delivery to the ball. As we have already defined the striking component of the swing as the forward stroke, this amounts to judging the distance in the setup with the ball. The judgment of an appropriate amount of said distance results from trial-and-error, which in turn informs the golfer's experience. The present invention facilitates the learning experience by providing a means to spot the ball a measured distance away, thereby defining the length of the stroke. This calibrated distance can be directly related to the distance the ball travels. After a few training swings, the golfer will be able to judge the correct ball-to-club placement and, together with the aiming features, deliver perfect strokes for sinking the cup.

It is, therefore, an object of the present invention to enable a golfer to improve putting performance by providing a tool to facilitate alignment. It is a further object to provide a means to detect a slope direction on the playing surface. It is a further object to provide a golfer with a means to judge an appropriate amount of swing. It is further object to provide a method for delivering a ball strike with the club head reliably squared to the is preferred direction. It is a further object to provide such tools and method in a compact device which might be carried in a golf bag. It is a further object to use common household objects, such as a retractable tape measure, to avoid construction complexity. It is a further object to facilitate both right-handed and left-handed golf swings.

These objects, and others to become hereinafter apparent, are embodied in a golf training apparatus for putting with a club head having parallel front and back surfaces. The golf training apparatus comprises a platform having a front edge, a back edge and a top surface, said platform moveably anchored to a playing surface; a means for orienting the platform to a preferred direction; a means for squaring the back surface of the club head in perpendicularity to the preferred direction, said squaring corresponding to an aim for striking a golf ball; and a means for spotting the golf ball a calibrated distance from the platform, said spotting corresponding to a striking force on the golf ball. As configured herein above, and with the platform oriented to a targeted destination by the means for orienting, the aim adjusted by the means for squaring and the striking force adjusted by the means for spotting, the club may deliver the golf ball to the destination by a forward stroke thereof while avoiding an anticipatory backstroke.

In a preferred embodiment, the means for orienting is a laser beam cast from a laser fixed to the platform in perpendicular arrangement to the front edge; the means for squaring is a vertical structure attached to the front edge of the platform; and the means for spotting the golf ball is a measuring device with graduation markings thereon.

In an alternate embodiment, a method for practice putting with a club head having parallel front and back surfaces, comprises the steps of placing a golf training apparatus on a playing surface, said golf training apparatus essentially the preferred apparatus embodiment supplemented with a bubble level for determining slope and at least two golf tees for anchoring the platform; aligning the golf training apparatus to a preferred direction, said preferred direction taking slope under consideration, by swiveling the platform about one of the anchoring golf tees to align the laser beam to reflect from a reflector placed in the path of the preferred direction; anchoring the golf training apparatus in place with the at least one other anchoring golf tee; placing the golf ball a calibrated distance from the vertical structure by reference to the measuring device; addressing the ball in a stance by facing perpendicularly to the preferred direction, said stance having one foot in an advance direction relative to the preferred direction, and lining up the advanced foot with the golf ball; placing the back surface of the club head against the vertical structure to align it with preferred direction and squaring it in approach to the golf ball; and swinging the club in a forward stroke to make an aimed and measuredly forceful strike on the golf ball.

As this is not intended to be an exhaustive recitation, other embodiments may be learned from practicing the invention or may otherwise become apparent to those skilled in the art.

DESCRIPTION OF THE DRAWINGS

Various other objects, features and attendant advantages of the present invention will become fully appreciated as the same becomes better understood through the accompanying drawings and the following detailed description, in which like reference characters designate the same or similar parts throughout the several views, and wherein.

DETAILED DESCRIPTION OF THE PREFERRED EMBODIMENT

Unless the context clearly requires otherwise, throughout the description and the claims, the term "squaring" will be taken to mean aligning a club head for a line of strike in an intended direction; the term "spotting" will be taken to mean placing a ball at an intended distance from a reference position; and the complex term "slope direction" will be taken in the downhill sense, or in the direction to which a rolling ball will break.

Figure 1:
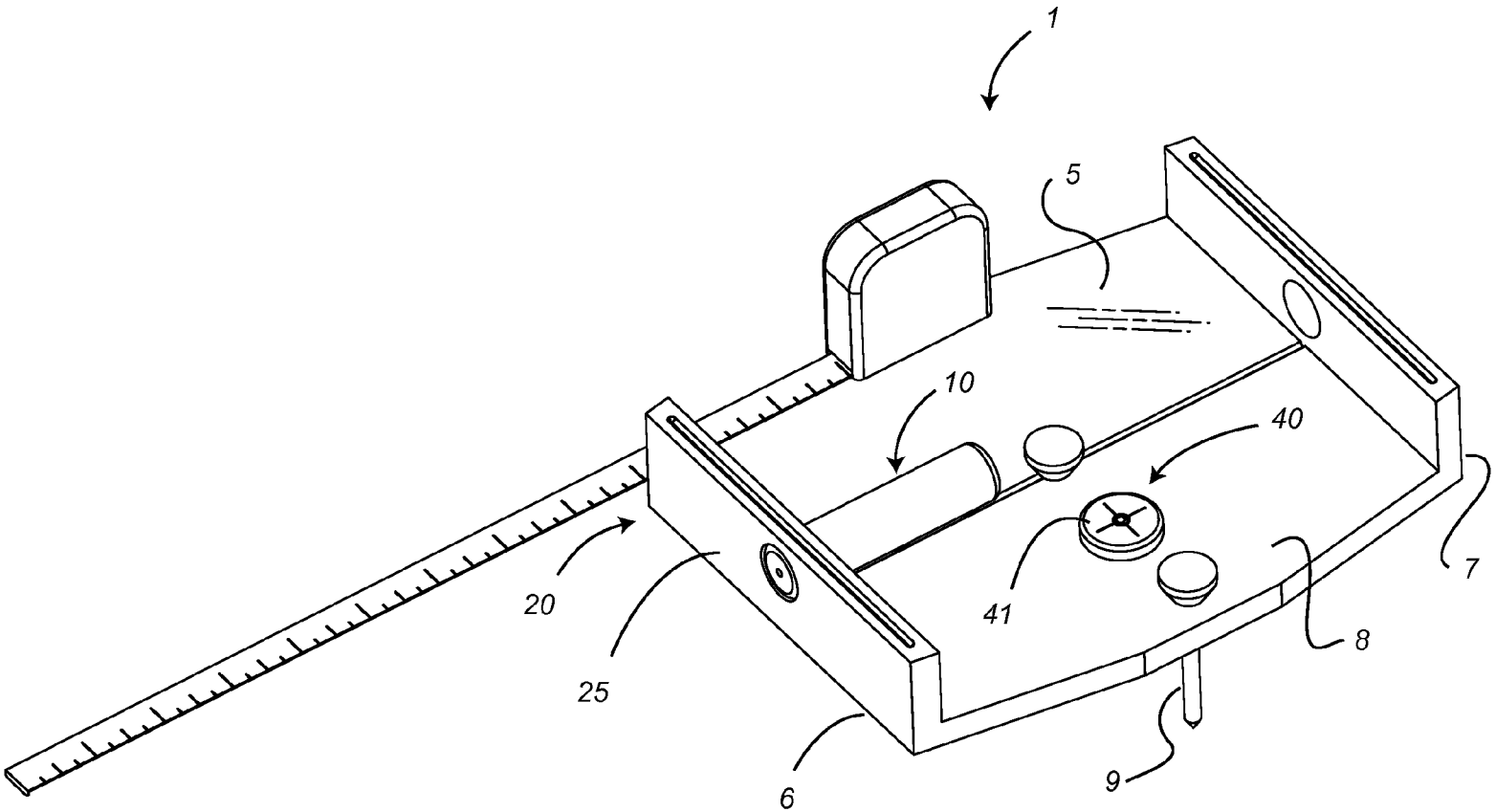
FIG. 1 is perspective view of the golf training apparatus embodiment of the present invention.
Figure 2:
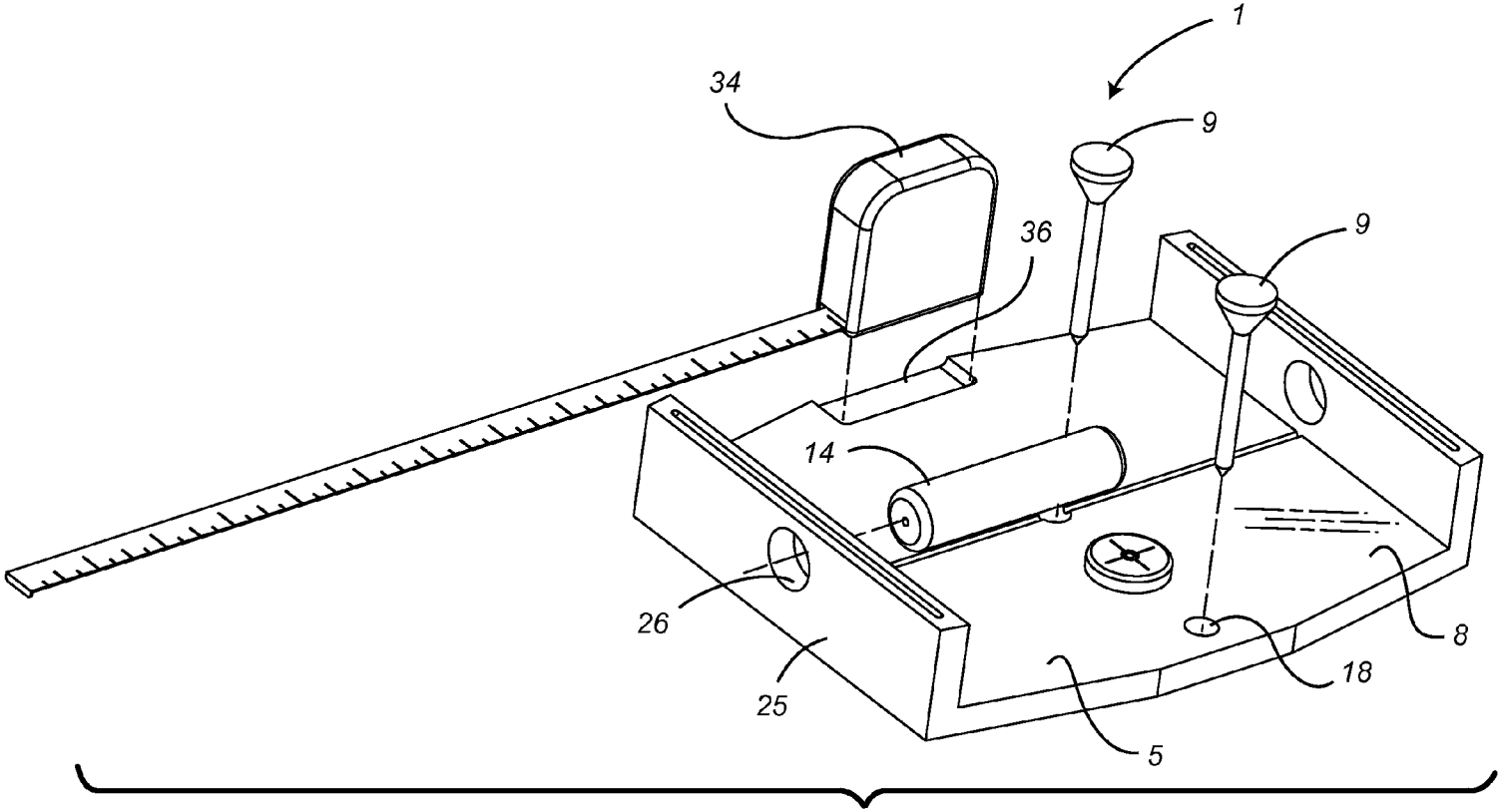
FIG. 2 is an exploded perspective view of the golf training apparatus.
Figure 4:
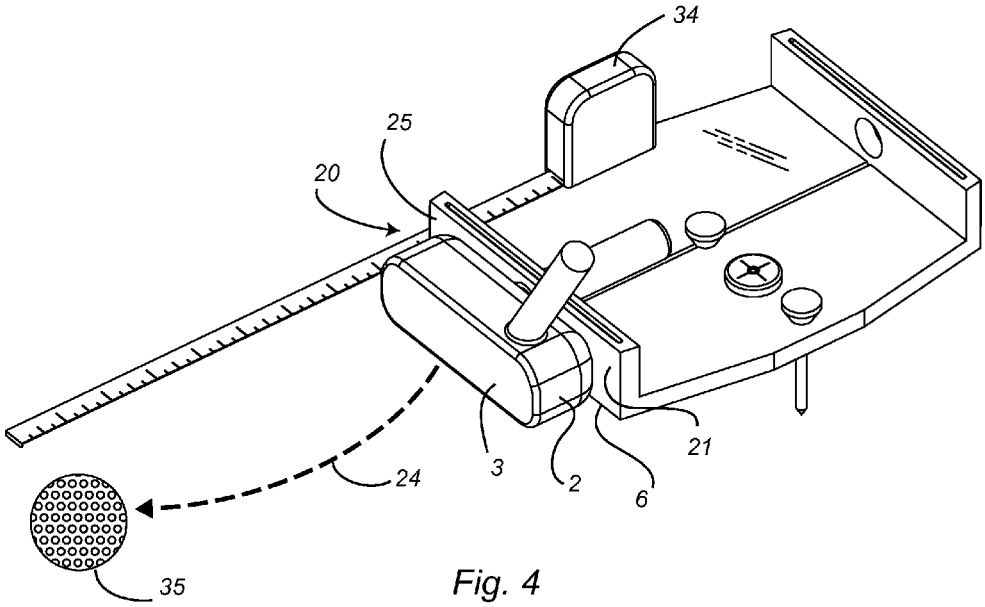
FIG. 4 is a perspective view showing the spotting of the golf ball and the club swing.

FIGS. 1, 2 and 4 show the constituent elements of a golf training apparatus 1. The golf training apparatus 1 is comprised of a platform 5 having a front edge 6, a back edge 7 and a top surface 8. The apparatus 1 is further comprised of a means for orienting 10 the platform 5, a means for squaring 20 a putter club head 2 and a means for spotting 30 a golf ball 35. With aim adjusted by the means for orienting 10 and the means for squaring 20, and the striking force adjusted by the means for spotting 30, the putter 2 will be repeatably enabled by a swing of the club, as will be shown herein below, to deliver the ball 35 to a targeted destination 12 (not shown). In the preferred embodiment, the swing is comprised of a forward stroke 24 without a preliminary backstroke 23 (not shown).

Figure 5:
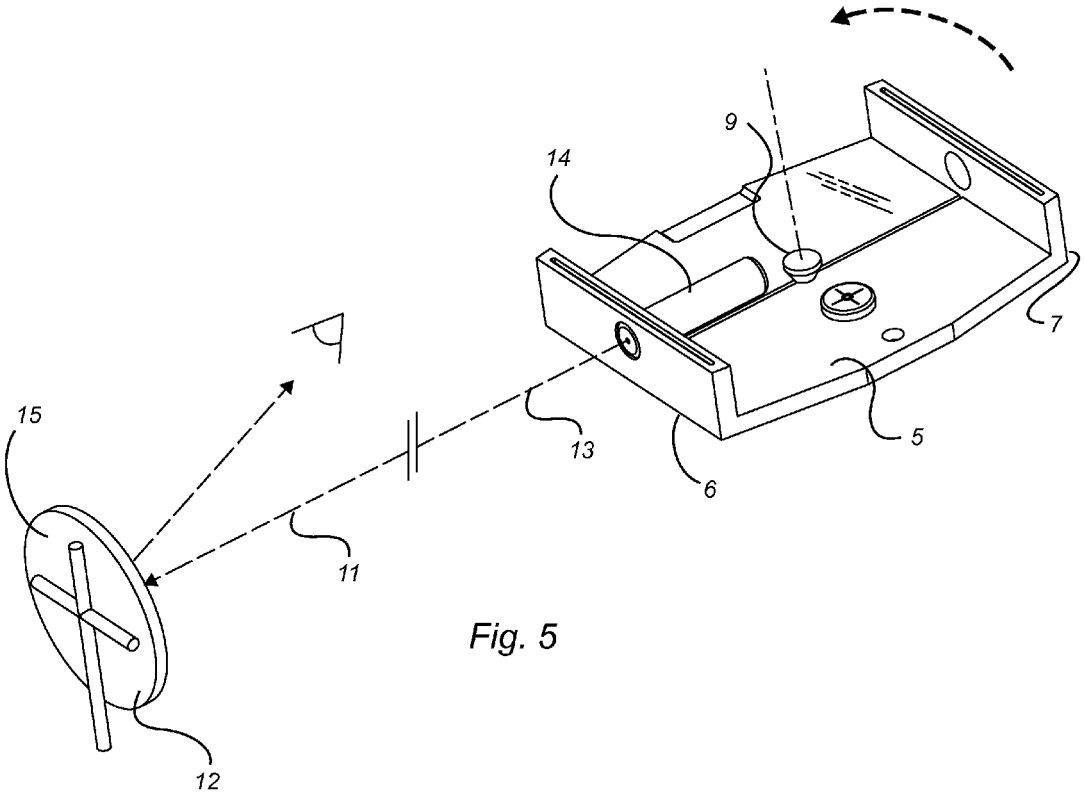
FIG. 5 is a perspective view showing the alignment of the apparatus using a laser.

In the preferred embodiment, the means for orienting 10 is comprised of a laser 14 casting a laser beam 13 toward the targeted destination 12, as shown best in FIG. 5. The means for orienting 10 may alternatively be comprised of any beam of light, such as from a flashlight, which has been lens-ably focused. The laser 14 is fixedly mounted on the platform 5 to be perpendicular to the platform front edge 6 or the platform back edge 7, as the case may be. The platform 5 is anchored to the playing surface, in the preferred embodiment, by at least two golf tees 9 (FIG. 2) thrust through anchor holes 18 in the top surface 8. Alternatively, headed nails may be used in place of golf tees. At least one of to the anchor holes 18 is placed centrally on the platform 5 so that the laser 14 may be pivoted about one of the golf tees 9 to orient the beam 13, the at least second golf tee 9 waiting to be placed until after the orientation is found. A reflector 15 may be placed in the path of a preferred direction 11 to confirm, by reflection, the aim of the laser beam 13.

Figure 3:
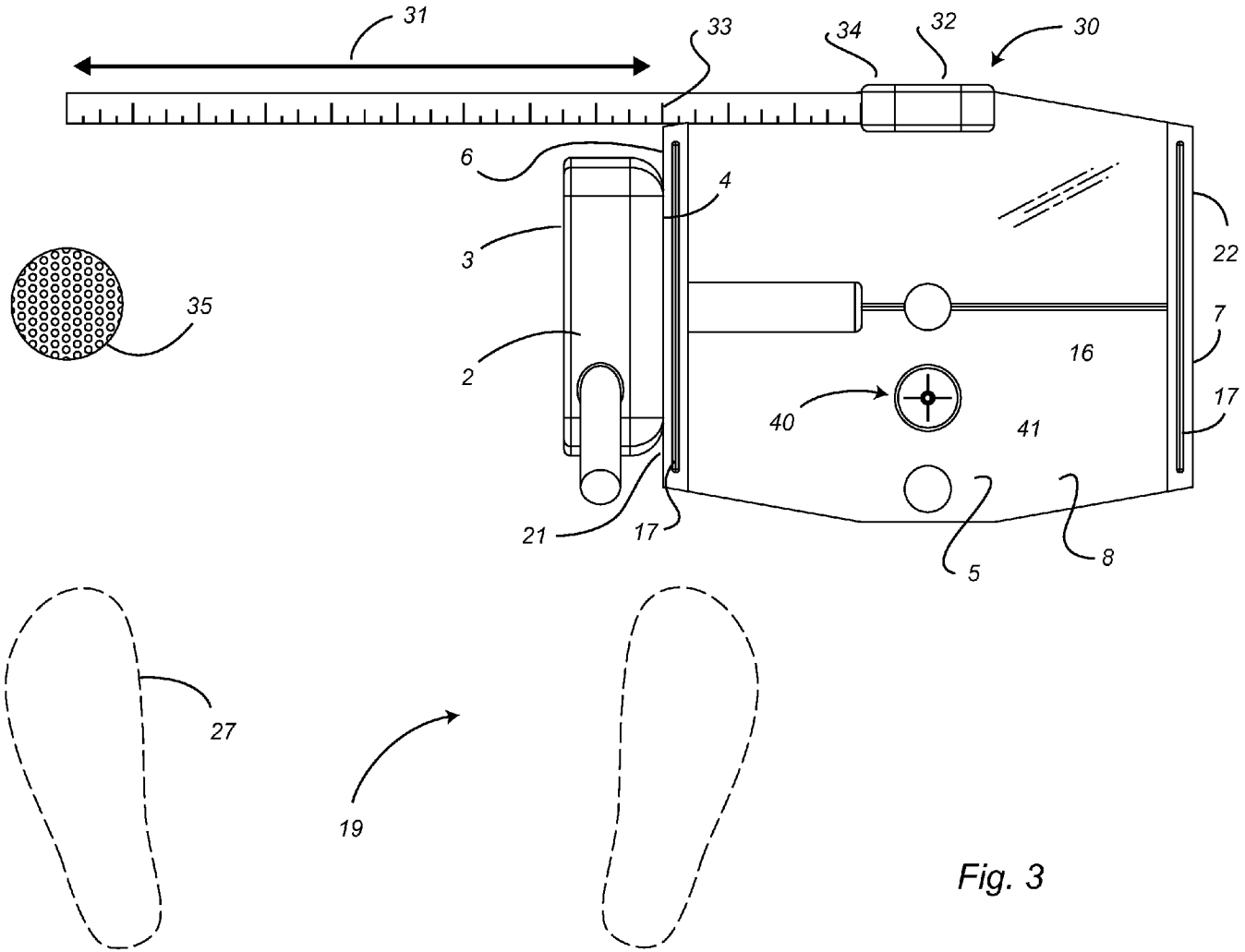
FIG. 3 is a plan view of the golf training apparatus showing placement of the club and stance of the golfer.

Markings may be used to help the golfer visualize orientation. Visualization is a known technique whereby a mental image can guide an actualization, such as in the case of a golf swing. In the preferred embodiment, the means for orienting 10 further comprises a first aiming line 16 placed in-line with the laser 14 on the platform top surface 8 to be readily visible to a golfer while addressing the ball, as shown in FIG. 3. One or more second aiming lines 17 may be placed perpendicular to the first aiming line 16 to guide the facing direction, and therefore the alignment of the golfer's feet, in a stance 19 of said address.

In the preferred embodiment, the means for squaring 20 is a first vertical structure 21 attached to the platform front edge 6, as shown in FIGS. 3 and 4. The means for squaring 20 may alternatively include any feature to which the putter club head 2 may be abutted in a perpendicular orientation to the preferred direction 11. In a particular preferred embodiment, the first vertical structure 21 is a vertical wall 25 having a laser aperture 26 there through, the aperture 26 providing a means for mounting the laser 14 (FIG. 2). To facilitate both right-handed and left-handed golfers, a second vertical structure 22 may be attached to the platform back edge 7. In taking up the stance 19, the golfer will shoulder to a back surface 4 of the club head 2 against the first vertical structure 21 (or the second vertical structure 22, as the case may be). Because a front surface 3 of the club head 2 is parallel to the back surface 4, the club head 2 is thereby enabled by squaring through perpendicularity with the preferred direction 11 to deliver an accurately aimed forward stroke 24 to the golf ball 35.

In the preferred embodiment, the means for spotting 30 is a measuring device 32 having graduated markings 33 thereon to mark a calibration distance 31 from either the front edge 6 or the back edge 7 of the platform 5, as shown in FIGS. 3 and 4. The means for spotting 30 may alternatively be any distance-indicating means, such as a string with regularly-placed knots, for example. In a particular preferred embodiment, the measuring device 32 is a retractable tape measure 34 placed midway between the front edge 6 and the back edge 7. The middle placement allows the tape measure to be reversed, in the sense of its extension direction, for the alternative-handed scenario. Because the measuring device 32 must, for interference reasons, always be on the opposite side of the platform 5 from the golfer's stance 19, the platform 5 cannot be considered to be pivotally bilateral; in other words, the second vertical structure 22 is necessitated by the feature. The tape measure 34 may be registered on the platform 5 by means of recess 36 (FIG. 2). The golf ball 35 is spotted in line with the squared club head 2 at a calibration distance 31 by reference to the extended tape of the tape measure 34, which indicates said distance by the markings 33 thereon. The calibration distance 31 corresponds to a length of the forward stroke 24 applied in each instance of said distance, said length corresponding, in turn, to a striking force on the ball 35. By means of altering the calibration distance 31, and thereby the spotting of the ball, the propulsive force of the stroke may be gauged for training purposes.

The golf training apparatus 1 further comprises a means for determining a slope direction 40 of the playing surface. In the preferred embodiment, the means for determining a is slope direction 40 comprises a bubble level 41 joined in some manner to the platform top surface 8. Alternatively, the means for determining slope 40 may be any means for determining inclination, such as a rolling marble placed on the top surface, for example. The slope direction must be combined with a line-of-sight to the targeted destination 12 to formulate a judgment call as to the preferred direction 11. Said judgment effectively compensates for a break in the ball's trajectory to the targeted destination 12 resulting from slope, or other surface anomaly.

The platform 5 may be constructed from any rigid material, including wood, metal or plastic. In the preferred embodiment, the construction is an injection molding of a commodity resin, such as high-density polyethylene (HDPE) or polypropylene (PP). The platform 5 can be configuring in any easily portable size, preferably a size that can be carried in a golf bag. In the case of the preferred embodiment, the dimensions of the platform are approximately six and half inches wide by eight inches long by one and three-quarter inches high (vertical wall 25). At least one or more corners of the platform 5 may be cut-away to permit the tape of the retractable tape measure 34 to extend perpendicularly from the front or back edge, as best shown in FIG. 3. The bubble level 41 may be bonded with the top surface 8 by glue, by double-faced tape or by any known attachment means. The laser 14 is of a handheld, battery-operated, pointer type, such as may be obtained from Alpec, for example. The laser 14 may be removably inserted into laser aperture 26 and held therein by friction fit or by compression of a rubber grommet.

The use of such a common household device as a tape measure, as opposed to integrating a retractable or foldable measuring device, simplifies the construction, and together with the small footprint of the apparatus, makes the equipment profile sufficiently small for convenience and portability. In a similar manner, the use of golf tees as anchoring devices signifies economy and resourcefulness in design.

Figure 6:
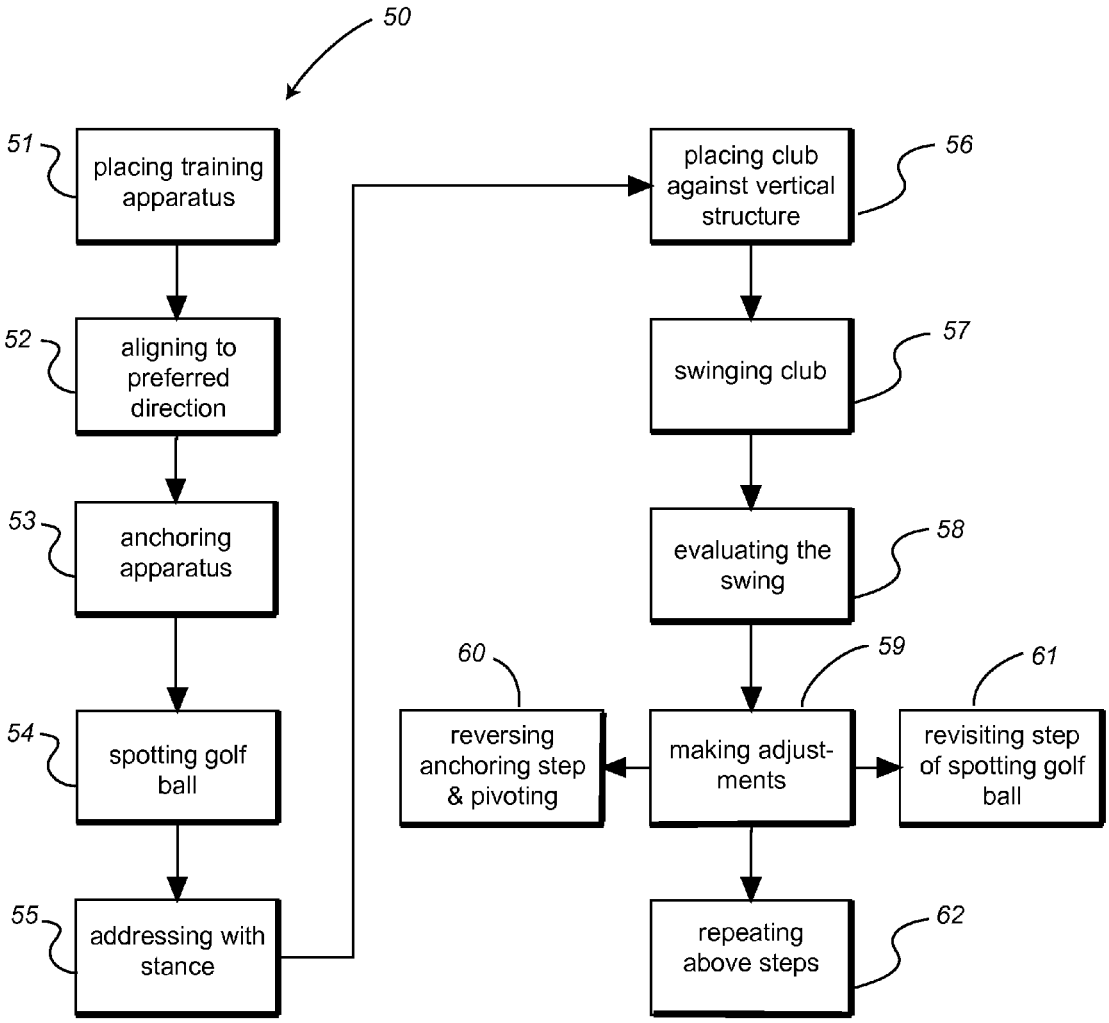
FIG. 6 is a diagram of a practice putting method embodiment of the present invention.

A method for practice putting 50, with a club head 2 having parallel front 3 and back 4 surfaces, is presented as an alternate embodiment, as shown in FIG. 6. The method for practice putting 50 comprises deploying a golf training apparatus 1 and using, therewith, the means for orienting 10, the means for squaring 20, the means for spotting 30 and the means for determining slope direction 40, as herein above recited, to deliver an aimed and calibrated forward stroke 24, and thereafter assessing accuracy of the stroke and making adjustments in repeated strokes until satisfactory results are achieved.

In a particular alternate embodiment, the method for practice putting 50 comprises:

in a step 51, placing a golf training apparatus 1 on a playing surface, said golf training apparatus 1 comprising a platform 5 having a front edge 6 and a top surface 8, said platform 5 moveably anchored to the playing surface by at least two golf tees 9 placed through anchor holes 18 in the top surface 8; a vertical structure 21 attached to at least the front edge 6; a laser 14 capable of throwing a beam 13 of light, said laser 14 fixed to the vertical structure 21 and oriented perpendicularly thereto; a bubble level 41 fixed to the platform 5, said bubble level 41 indicating slope and direction thereof; and a tape measure 34 having graduation markings 33 on a tape, said tape measure 34 retractably extending the tape perpendicularly to the vertical structure 21 to provide a calibration distance 31 to a golf ball 35;

in a step 52, aligning the golf training apparatus 1 to a preferred direction 11, said preferred direction 11 taking slope under consideration, by swiveling the platform about one of the anchoring golf tees 9 to align the laser beam 13 to reflect from a reflector 15 placed in the path of the preferred direction 11;

in a step 53, anchoring the golf training apparatus 1 in place with the at least one other anchoring golf tee 9;

in a step 54, spotting the golf ball 35 a calibrated distance 31 from the vertical structure 21 by reference to the extended tape;

in a step 55, addressing the ball 35 by facing perpendicularly to the preferred direction in a stance 19, said stance 19 having one foot in an advance direction relative to the preferred direction 11, and placing the advanced foot 27 (FIG. 3) in line with the golf ball 35;

in a step 56, placing the back surface 4 of the club head 2 against the vertical structure 21 to align it with preferred direction 11 and square it in approach to the golf ball 35;

in a step 57, swinging the club in a forward stroke 24 to make an aimed and critically impactful strike on the golf ball 35;

in a step 58, evaluating the swing in light of the resulting ball travel, wherein the step 58 includes an assessment of correct aim and correct impact force relative to placing the golf ball 35 accurately at a targeted destination 12;

in a step 59, making adjustments, wherein the step 59 further includes step 60, said step reversing step 53 and pivoting the golf training apparatus 1 to adjust for aim and step 61, said step revisiting step 54 to adjust for striking force; and in a step 62, repeating all of the above steps until accuracy is achieved.

It is to be understood that the invention is not limited in its application to the details of construction, to the arrangements of the components and to the method of using set forth in the preceding description or illustrated in the drawings. For example, the platform 5 could be reduced to a foldable "T", in the extreme of light-weighting. Also, it is to be understood that the phraseology and terminology employed herein are for the purpose of the description and should not be regarded as limiting.

What is claimed is:

1. A golf training apparatus for putting with a club head having parallel front and back surfaces, comprising:

a platform having a front edge, a back edge and a top surface, said platform moveably anchored to a playing surface;

a laser beam cast from a laser fixed to the platform in perpendicular arrangement to the front edge, said laser beam marking a preferred direction by projecting onto a reflector placed on or near the targeted destination and aimed thereto by moving the platform;

a means for squaring the back surface of the club head in perpendicularity to the preferred direction, said squaring corresponding to an aim for striking a golf ball; and a means for spotting the golf ball a calibrated distance from the platform, said spotting corresponding to a striking force on the golf ball;

whereby, with the platform oriented to a targeted destination by the means for orienting, the aim adjusted by the means for squaring and the striking force adjusted by the means for spotting, the club may deliver the golf ball to the destination by a forward stroke thereof while avoiding an anticipatory backstroke.

2. The golf training apparatus of claim 1, further comprising a means for determining a slope direction to the playing surface.

3. The golf training apparatus of claim 2, wherein the means for determining a slope direction comprises a bubble level.

4. The golf training apparatus of claim 1, wherein the platform is movably anchored by at least two golf tees placed though anchor holes in the top surface.

5. The golf training apparatus of claim 1, wherein the means for squaring is a first vertical structure attached to the front edge of the platform, said vertical structure oriented substantially perpendicular to the preferred direction.

6. The golf training apparatus of claim 5, wherein the means for squaring further comprises a second vertical structure attached to the back edge of the platform, the second vertical structure performing the same function as the first vertical structure for an alternative-handed golfer.

7. The golf training apparatus of claim 1, wherein the means for spotting the golf ball is a measuring device with graduation markings thereon.

8. The golf training apparatus of claim 7, wherein the measuring device is a retractable tape measure.

9. The golf training apparatus of claim 1, further comprising a first aiming line drawn on the top surface of the platform, the first aiming line indicating the preferred direction.

10. The golf training apparatus of claim 9, further comprising at least one second aiming line, said at least one second aiming line perpendicular to the first aiming line and indicating a facing orientation for addressing the golf ball in a stance.

11. A method for practice putting with a club head having parallel front and back surfaces, comprising the steps:

placing a golf training apparatus on a playing surface, said golf training apparatus comprising a platform having a front edge and a top surface, said platform moveably anchored to the playing surface by at least two golf tees placed through anchor holes in the top surface; a vertical structure attached to at least the front edge; a laser capable of throwing a beam of light, said laser fixed to the vertical structure and oriented perpendicularly thereto; a bubble level fixed to the platform, said bubble level indicating slope and direction thereof; and a tape measure having graduation markings on a tape, said tape measure retractably extending the tape perpendicularly to the vertical structure to provide a calibration distance to a golf ball;

aligning the golf training apparatus to a preferred direction, said preferred direction taking slope under consideration, by swiveling the platform about one of the anchoring golf tees to align the laser beam to reflect from a reflector placed in the path of the preferred direction;

anchoring the golf training apparatus in place with the at least one other anchoring golf tee;

spotting the golf ball a calibrated distance from the vertical structure by reference to the extended tape;

addressing the ball by facing perpendicularly to the preferred direction in a stance, said stance having one foot in an advance direction relative to the preferred direction, and placing the advanced foot in line with the golf ball;

placing the back surface of the club head against the vertical structure to align it with preferred direction and square it in approach to the golf ball; and swinging the club in a forward stroke to make an aimed and critically impactful strike on the golf ball.

12. The method of claim 11, further comprising the step of evaluating the swing in light of the resulting ball travel.

13. The method claim 12, wherein the step of evaluating the swing includes an assessment of correct aim and correct impact force relative to placing the golf ball accurately at a targeted destination.

14. The method of claim 13, further comprising the step of making adjustments.

15. The method of claim 14, wherein the step of making adjustments includes reversing the anchoring step and pivoting the golf training apparatus to adjust for aim.

16. The method of claim 15, wherein the step of spotting the golf ball is revisited to adjust for striking force, the greater force corresponding to an increased calibration distance.

17. The method of claim 16, further comprising repeating all of the above steps until accuracy is achieved.

* * * * *